US008837977B2

(12) United States Patent
Tanaka

(10) Patent No.: US 8,837,977 B2
(45) Date of Patent: Sep. 16, 2014

(54) CHARGING DEVICE AND IMAGE FORMING APPARATUS

(75) Inventor: Arichika Tanaka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 228 days.

(21) Appl. No.: 13/483,739

(22) Filed: May 30, 2012

(65) Prior Publication Data

US 2013/0156461 A1 Jun. 20, 2013

(30) Foreign Application Priority Data

Dec. 14, 2011 (JP) ..... 2011-273559

(51) Int. Cl.
*G03G 15/02* (2006.01)
*G03G 21/00* (2006.01)

(52) U.S. Cl.
CPC ..... *G03G 15/0291* (2013.01); *G03G 21/00* (2013.01)
USPC ..... 399/100

(58) Field of Classification Search
CPC ..... G03G 15/0291; G03G 21/00
USPC ..... 399/100
See application file for complete search history.

(56) References Cited

U.S. PATENT DOCUMENTS

| | | | | |
|---|---|---|---|---|
| 5,089,850 | A * | 2/1992 | Ogura et al. | 399/99 |
| 2007/0065173 | A1* | 3/2007 | Sekovski et al. | 399/100 |
| 2008/0199206 | A1* | 8/2008 | Zona et al. | 399/100 |
| 2010/0158558 | A1* | 6/2010 | Hano | 399/100 |

FOREIGN PATENT DOCUMENTS

JP A-2004-109394 4/2004

* cited by examiner

*Primary Examiner* — David Gray
*Assistant Examiner* — Thomas Giampaolo, II
(74) *Attorney, Agent, or Firm* — Oliff PLC

(57) ABSTRACT

A charging device includes a discharge electrode that charges a surface of a rotatable image carrier and extends along the image carrier, a case that extends along and encloses the discharge electrode with a side thereof nearest to the image carrier being open, a grid electrode provided between the image carrier and the discharge electrode, a cleaning member that cleans at least one of the discharge electrode, the case, and the grid electrode by moving along the case, a regulating portion that is provided between the cleaning member and the case and regulates a distance between the cleaning member and the case in a direction orthogonal to the direction of movement of the cleaning member by coming into contact with the cleaning member or the case, and a supporting portion that supports the regulating portion and allows the regulating portion to move away from the cleaning member or the case.

7 Claims, 15 Drawing Sheets

CHARGING DEVICE AND IMAGE FORMING APPARATUS

CROSS-REFERENCE TO RELATED APPLICATIONS

This application is based on and claims priority under 35 USC 119 from Japanese Patent Application No. 2011-273559 filed Dec. 14, 2011.

BACKGROUND (i) Technical Field

The present invention relates to a charging device and an image forming apparatus.

SUMMARY

According to an aspect of the invention, there is provided a charging device including a discharge electrode that faces a surface of a rotatable image carrier and charges the surface of the image carrier, the discharge electrode having a substantially long shape extending in a direction in which a rotational axis of the image carrier extends; a case that extends in a longitudinal direction of the discharge electrode and encloses the discharge electrode, a side of the case nearest to the image carrier being open; a substantially plate-shaped grid electrode that is provided between the image carrier and the discharge electrode; a cleaning member that cleans at least one of the discharge electrode, the case, and the grid electrode by being guided along the case and moving in a longitudinal direction of the case; a regulating portion that is provided between the cleaning member and the case and regulates a distance between the cleaning member and the case in a direction orthogonal to the direction of movement of the cleaning member by coming into contact with one of the cleaning member and the case; and a supporting portion that supports the regulating portion and allows the regulating portion to move in a direction away from one of the cleaning member and the case with which the regulating portion is to come into contact.

BRIEF DESCRIPTION OF THE DRAWINGS

Exemplary embodiments of the present invention will be described in detail based on the following figures, wherein.

DETAILED DESCRIPTION

A charging device and an image forming apparatus according to a first exemplary embodiment of the present invention will now be described with reference to FIGS. 1 to 13.

Overall Configuration

Figure 13:
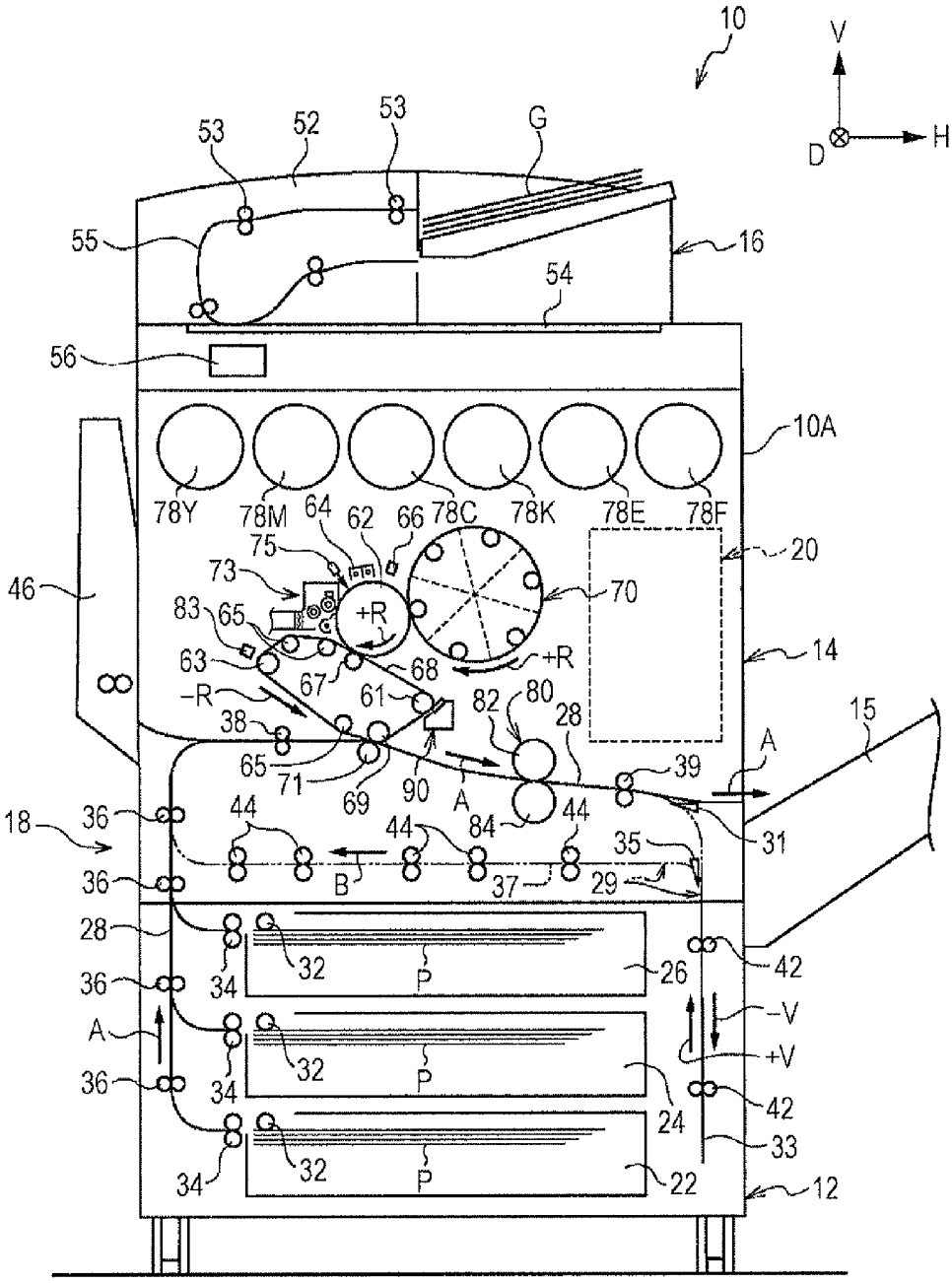
FIG. 13 schematically illustrates the image forming apparatus according to the first exemplary embodiment of the present invention.

Referring to FIG. 13, an image forming apparatus 10 according to the first exemplary embodiment includes, from the bottom to the top thereof in the vertical direction (the direction of arrow V), a storage section 12 in which sheet members P as recording media are stored, a transport section 18 that transports each of the sheet members P stored in the storage section 12, an image forming section 14 that is provided above the storage section 12 and forms an image on the sheet member P transported thereto from the storage section 12 by the transport section 18, a document reading section 16 that is provided above the image forming section 14 and reads a document G, and a controller 20 that is provided in the image forming section 14 and controls operations of elements included in the image forming apparatus 10.

Hereinafter, the vertical direction (the direction of arrow V illustrated in FIG. 13), the horizontal direction (the direction of arrow H illustrated in FIG. 13), and the depth direction (the direction of arrow D illustrated in FIG. 13) of an apparatus body 10A of the image forming apparatus 10 are simply referred to as the vertical direction, the horizontal direction, and the depth direction, respectively.

Storage Section

The storage section 12 includes a first storage unit 22, a second storage unit 24, and a third storage unit 26 that are arranged in the vertical direction and store sheet members P of respectively different sizes. The first storage unit 22, the second storage unit 24, and the third storage unit 26 are provided with respective feed rollers 32 that feed any of the sheet members P stored therein into a transport path 28 defined in the transport section 18.

Transport Section

The transport section 18 includes transport rollers 34 and transport rollers 36 provided on the downstream side with respect to the feed rollers 32 in a direction in which the sheet member P is transported (hereinafter simply referred to as the downstream side in the direction of transport). The transport rollers 34 and 36 transport the sheet members P one by one. Registration rollers 38 are also provided at a position of the transport path 28 that is on the downstream side in the direction of transport with respect to the transport rollers 36. The registration rollers 38 temporarily stop the sheet member P and then feed the sheet member P to a second transfer position, to be described separately below, with a predetermined timing.

A portion of the transport path 28 that resides below the image forming section 14 and on the downstream side in the direction of transport extends, in front view of the image forming apparatus 10, from the lower left of the image forming section 14 to a sheet output portion 15 provided on a right sidewall of the image forming section 14. The transport path 28 is connected to a duplex transport path 29 into which the sheet member P is transported and in which the sheet member P is reversed so that images are formed on both sides of the sheet member P.

The duplex transport path 29 includes, in front view of the image forming apparatus 10, a first switching member 31 that switches the transport path between the transport path 28 and the duplex transport path 29, a reversing portion 33 extending from the lower right of the image forming section 14 and linearly in the vertical direction along the right side of the storage section 12, a transport portion 37 into which the trailing end of the sheet member P transported into the reversing portion 33 is introduced and along which the sheet member P is transported in the horizontal direction, and a second switching member 35 that switches the transport path between the reversing portion 33 and the transport portion 37. Transport rollers 42 are provided at plural positions of the reversing portion 33 at certain intervals. Transport rollers 44 are provided at plural positions of the transport portion 37 at certain intervals.

The first switching member 31 has a triangular-prism shape in sectional view and is moved by a drive unit (not illustrated) such that the tip thereof is oriented toward either of the transport path 28 and the duplex transport path 29, whereby the direction of transport of the sheet member P is switched. Likewise, the second switching member 35 has a triangular-prism shape in sectional view and is moved by a drive unit (not illustrated) such that the tip thereof is oriented toward either of the reversing portion 33 and the transport portion 37, whereby the direction of transport of the sheet member P is switched.

An end of the transport portion 37 on the downstream side in the direction of transport is connected to the transport path 28 with a guide member (not illustrated). A foldable manual feed portion 46 is provided on the left sidewall of the image forming section 14. The manual feed portion 46 is connected to a portion of the transport path 28 before the registration rollers 38.

Document Reading Section

The document reading section 16 provided at the top of the image forming apparatus 10 includes a document transport device 52 that automatically transports each piece of document G to be read by the document reading section 16, a platen glass 54 provided below the document transport device 52 and on which a piece of document G is to be placed, and a document reading device 56 that reads each piece of document G transported by the document transport device 52 or placed on the platen glass 54.

The document transport device 52 has an automatic transport path 55 along which transport rollers 53 are provided at plural positions. A portion of the automatic transport path 55 is defined such that the document G runs on the platen glass 54. The document reading device 56 is stationary at the left end of the platen glass 54 when reading the document G transported by the document transport device 52, and moves in the horizontal direction when reading the document G placed on the platen glass 54.

Image Forming Section

The image forming section 14 provided below the document reading section 16 includes an image carrier 62 having a cylindrical shape. The image carrier 62 resides in the middle part of the apparatus body 10A of the image forming apparatus 10 and is configured to carry a toner image to be formed on the surface thereof. The image carrier 62 is rotated in the direction of arrow +R (clockwise in FIG. 13) by a drive unit (not illustrated) and is configured to carry an electrostatic latent image to be formed by application of light thereto. A scorotron charging device 64 that charges the surface of the image carrier 62 is provided above the image carrier 62 in such a manner as to face the surface of the image carrier 62. Details of the charging device 64 will be described separately below.

An exposure device 66 is provided on the downstream side in the direction of rotation of the image carrier 62 with respect to the charging device 64 in such a manner as to face the surface of the image carrier 62. The exposure device 66 includes light-emitting diodes (LEDs) and is configured to apply light to (perform exposure on) the surface of the image carrier 62 that is charged in advance by the charging device 64. The light is applied in accordance with image signals corresponding to different toner colors. Thus, an electrostatic latent image is formed on the surface of the image carrier 62. The exposure device 66 is not limited to be of an LED type and may be, for example, configured to perform laser-beam scanning with a polygon mirror.

A rotary developing device 70 is provided on the downstream side in the direction of rotation of the image carrier 62 with respect to a position to which the exposure device 66 applies exposure light. The developing device 70 develops and visualizes, with toners of predetermined colors, the electrostatic latent image formed on the surface of the image carrier 62.

Figure 12:
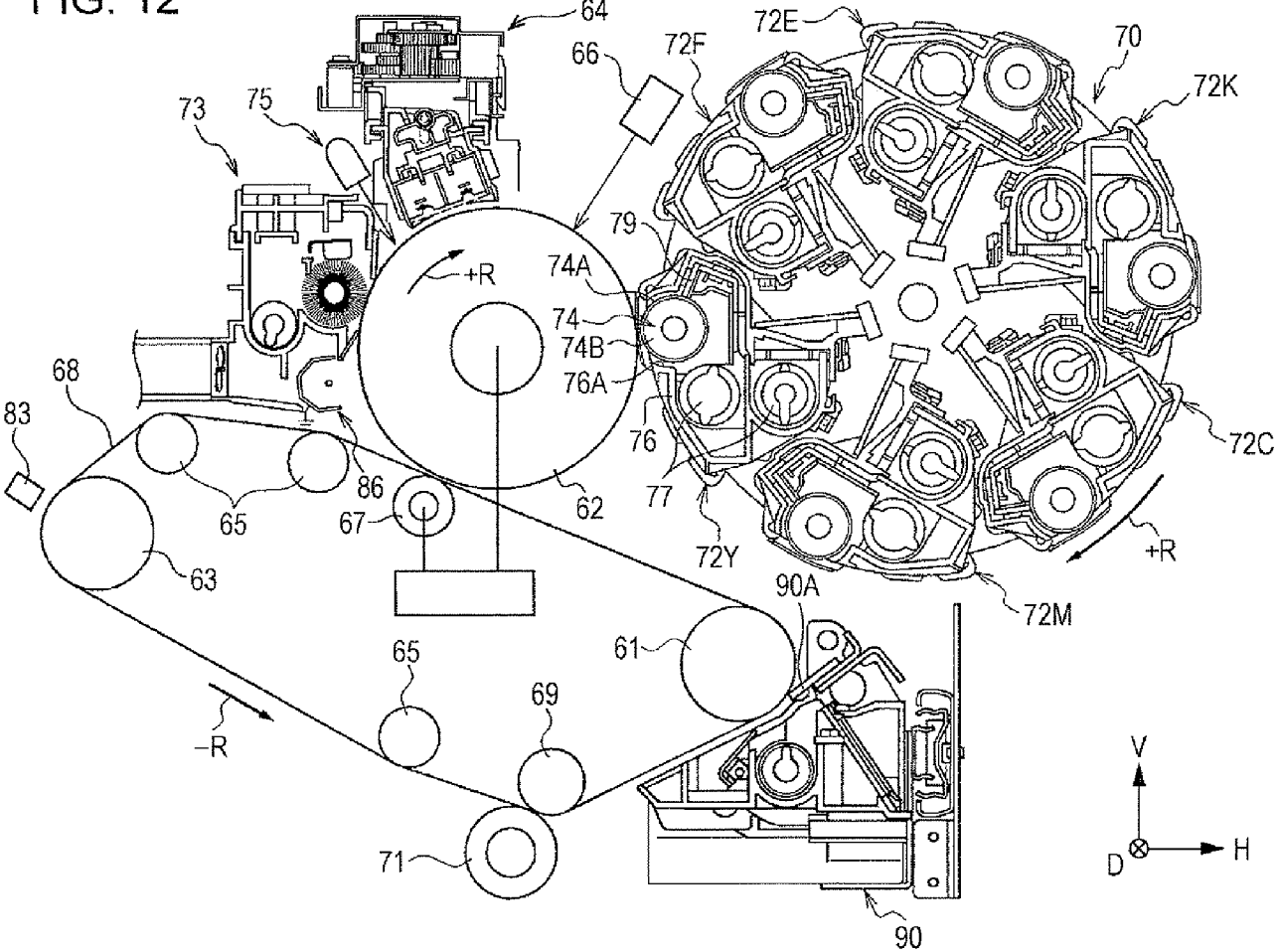
FIG. 12 illustrates the charging device, a developing device, and other elements included in the image forming apparatus according to the first exemplary embodiment of the present invention.

Referring to FIG. 12, the developing device 70 includes developing units 72Y, 72M, 72C, 72K, 72E, and 72F corresponding to respective toner colors of yellow (Y), magenta (M), cyan (C), black (K), a first special color (E), and a second special color (F) and arranged in that order in the circumferential direction (counterclockwise). The developing device 70 is rotated by a center angle of 60 degrees at a time by a motor (not illustrated) as a rotating unit, whereby the development unit to be used for development is switched among the developing units 72Y, 72M, 72C, 72K, 72E, and 72F and faces the surface of the image carrier 62. Since the developing units 72Y, 72M, 72C, 72K, 72E, and 72F all have the same configuration, the developing unit 72Y will be described herein, and description of the other developing units 72M, 72C, 72K, 72E, and 72F is omitted.

The developing unit 72Y includes a case member 76 that forms the body thereof. The case member 76 is filled with a developer (not illustrated) containing a toner and a carrier. The developer is supplied from a toner cartridge 78Y (see FIG. 13) through a toner supply path (not illustrated). The case member 76 has a rectangular opening 76A that faces the surface of the image carrier 62. A developing roller 74 is provided in the opening 76A such that the surface thereof faces the surface of the image carrier 62. A plate-shaped regulating member 79 that regulates the thickness of a layer of the developer is also provided in the case member 76 at a position near the opening 76A. The regulating member 79 extends in the longitudinal direction of the opening 76A.

The developing roller 74 includes a rotatable developing sleeve 74A having a cylindrical shape and a magnetic member 74B fixedly provided inside the developing sleeve 74A and having plural magnetic poles. When the developing sleeve 74A rotates, a magnetic brush made of the developer (the carrier) is formed and the regulating member 79 regulates the thickness of the magnetic brush, whereby a developer layer is formed on the surface of the developing sleeve 74A. The developer layer on the surface of the developing sleeve 74A is transported to a position facing the image carrier 62, and the toner is made to adhere to the electrostatic latent image formed on the surface of the image carrier 62. Thus, the electrostatic latent image is developed into a toner image.

Two transport augers 77 each having a helical shape are rotatably provided side by side in the case member 76. When the two transport augers 77 rotate, the developer in the case member 76 is circulated and is transported in the axial direction of the developing roller 74 (in the longitudinal direction of the developing unit 72Y). The developing units 72Y, 72M, 72C, 72K, 72E, and 72F have, in total, six respective developing rollers 74. The developing rollers 74 are arranged in the circumferential direction such that the distance between each pair of adjacent developing rollers 74 corresponds to a center angle of 60 degrees. With a single action of switching among the developing units 72, the next one of the developing rollers 74 comes to face the surface of the image carrier 62.

An endless intermediate transfer belt 68 is provided on the downstream side in the direction of rotation of the image carrier 62 with respect to the developing device 70 and below the image carrier 62. The toner image formed on the surface of the image carrier 62 is transferred to the intermediate transfer belt 68. The intermediate transfer belt 68 is stretched around a driving roller 61 that is driven to rotate by the controller 20 (see FIG. 13), a tension applying roller 63 that applies tension to the intermediate transfer belt 68, plural transport rollers 65 that are in contact with the inner surface of the intermediate transfer belt 68 and rotate by following the rotation of the intermediate transfer belt 68, and an assist roller 69 that is in contact with the inner surface of the intermediate transfer belt 68 and rotates by following the rotation of the intermediate transfer belt 68. When the driving roller 61 rotates, the intermediate transfer belt 68 rotates in the direction of arrow –R (counterclockwise in FIG. 12).

A first transfer roller 67 is provided across the intermediate transfer belt 68 from the image carrier 62. The first transfer roller 67 first-transfers the toner image formed on the surface of the image carrier 62 to the intermediate transfer belt 68. The first transfer roller 67 is in contact with the inner surface of the intermediate transfer belt 68 at a position on the downstream side in the direction of rotation of the intermediate transfer belt 68 with respect to a position at which the image carrier 62 is in contact with the intermediate transfer belt 68. When power is supplied to the first transfer roller 67 from a power source (not illustrated), the first transfer roller 67 first-transfers the toner image on the image carrier 62 to the intermediate transfer belt 68 by utilizing the potential difference from the image carrier 62, which is grounded.

A second transfer roller 71 is provided across the intermediate transfer belt 68 from the assist roller 69. The second transfer roller 71 second-transfers the toner image first-transferred to the intermediate transfer belt 68 to the sheet member P. The nip between the second transfer roller 71 and the assist roller 69 is defined as the second transfer position at which the toner image is transferred to the sheet member P. The second transfer roller 71 is in contact with the outer surface of the intermediate transfer belt 68. The second transfer roller 71 is grounded. A bias is applied to the shaft of the assist roller 69 by a power source (not illustrated). The toner image on the intermediate transfer belt 68 is second-transferred to the sheet member P by utilizing the potential difference between the biased assist roller 69 and the grounded second transfer roller 71.

A cleaning device 90 including a blade 90A is provided across the intermediate transfer belt 68 from the driving roller 61. The blade 90A scrapes toner residues remaining on the intermediate transfer belt 68 after the second transfer.

A position detecting sensor 83 is provided at a position near the outer circumference of the intermediate transfer belt 68 and facing the tension applying roller 63. The position detecting sensor 83 detects a predetermined reference position on the intermediate transfer belt 68 by detecting a mark (not illustrated) provided on the outer surface of the intermediate transfer belt 68, and outputs a position detection signal with reference to which an image forming process is started.

A corotron adjusting charger 86 is provided on the downstream side in the direction of rotation of the image carrier 62 with respect to the first transfer roller 67. The adjusting charger 86 negatively charges the surface of the image carrier 62, thereby adjusting the potential of the charge on the surface of the image carrier 62. A cleaning device 73 is provided on the downstream side in the direction of rotation of the image carrier 62 with respect to the adjusting charger 86. The cleaning device 73 removes toner residues not having been first-transferred to the intermediate transfer belt 68 and remaining on the surface of the image carrier 62, and other unwanted matter.

A static eliminator 75 is provided on the downstream side in the direction of rotation of the image carrier 62 with respect to the cleaning device 73 (on the upstream side with respect to the charging device 64). The static eliminator 75 eliminates static electricity from the surface of the image carrier 62 by applying light to the image carrier 62.

Referring to FIG. 13, the second transfer position at which the second transfer of the toner image is performed by the second transfer roller 71 is defined at a halfway position of the transport path 28. A fixing device 80 is provided at a position of the transport path 28 that is on the downstream side in the direction of transport of the sheet member P (indicated by arrow A) with respect to the second transfer roller 71. The fixing device 80 fixes, on the sheet member P, the toner image transferred to the sheet member P by the second transfer roller 71.

The fixing device 80 includes a heating roller 82 and a pressure roller 84. The heating roller 82 is provided on a side (upper side) of the sheet member P having the toner image and includes a heat source that generates heat when powered. The pressure roller 84 is provided below the heating roller 82 and presses the sheet member P against the surface of the heating roller 82. Transport rollers 39 are provided at a position on the transport path 28 that is on the downstream side in the direction of transport of the sheet member P with respect to the fixing device 80. The transport rollers 39 transport the sheet member P toward the sheet output portion 15 or the reversing portion 33.

Toner cartridges 78Y, 78M, 78C, 78K, 78E, and 78F that are individually replaceable are provided side by side in the horizontal direction below the document reading device 56 and above the developing device 70. The toner cartridges 78Y, 78M, 78C, 78K, 78E, and 78F contain toners having respective colors of yellow (Y), magenta (M), cyan (C), black (K), the first special color (E), and the second special color (F).

The first special color E and the second special color F are selected from special colors (including a transparent color) other than yellow, magenta, cyan, and black, or are otherwise not selected. If any colors are selected as the first and second special colors E and F, the developing device 70 performs image formation by using the six colors of Y, M, C, K, E, and F. If no colors are selected as the first and second special colors E and F, the developing device 70 performs image formation by using the four colors of Y, M, C, and K. The first exemplary embodiment concerns a case where image formation is performed by using the four colors of Y, M, C, and K without using the first and second special colors E and F. Alternatively, image formation may be performed by using five colors in total: the four colors of Y, M, C, and K and one of the first and second special colors E and F.

In the configuration described above, when the image forming apparatus 10 is activated, pieces of image data for the respective colors of yellow (Y), magenta (M), cyan (C), and black (K) are sequentially output to the exposure device 66 from an image processing apparatus (not illustrated) or any external apparatus. At this time, the developing device 70 is rotated and is retained such that, for example, the developing unit 72Y (see FIG. 12) faces the surface of the image carrier 62. Furthermore, the blade 90A of the cleaning device 90 and the second transfer roller 71 are held away from the outer surface of the intermediate transfer belt 68 before toner images in the respective colors are multiply transferred (first-transferred) to the intermediate transfer belt 68.

Subsequently, light is emitted from the exposure device 66 in accordance with each of the pieces of image data, and the surface of the image carrier 62 that has been charged by the charging device 64 is exposed to the light. Thus, an electrostatic latent image corresponding to the piece of image data for, for example, yellow is formed on the surface of the image carrier 62. The electrostatic latent image thus formed on the surface of the image carrier 62 is developed into a yellow toner image by the developing unit 72Y. The yellow toner image on the surface of the image carrier 62 is then transferred to the intermediate transfer belt 68 by the first transfer roller 67.

Subsequently, the developing device 70 is rotated by 60 degrees in the direction of arrow +R, whereby the developing unit 72M comes to face the surface of the image carrier 62. Through the processes of charging, exposure, and development, a magenta toner image is formed on the surface of the image carrier 62 and is transferred to the intermediate transfer belt 68 by the first transfer roller 67 in such a manner as to be superposed on the yellow toner image. Likewise, cyan (C) and black (K) toner images are sequentially and multiply transferred to the intermediate transfer belt 68. When the transfer of the toner images to the intermediate transfer belt 68 is finished, the blade 90A of the cleaning device 90 and the second transfer roller 71 are brought into contact with the outer surface of the intermediate transfer belt 68.

Meanwhile, the sheet member P that has been fed from the storage section 12 and has been transported along the transport path 28 is transported to the second transfer position by the registration rollers 38 with the timing of the multiple transfer of the toner images to the intermediate transfer belt 68. The toner images that have been multiply transferred to the intermediate transfer belt 68 are second-transferred by the second transfer roller 71 to the sheet member P transported to the second transfer position. Furthermore, toner residues on the surface of the intermediate transfer belt 68 are scraped off the intermediate transfer belt 68 by the blade 90A and are collected in the cleaning device 90.

Subsequently, the sheet member P having the toner images transferred thereto is transported in the direction of arrow A (to the right in FIG. 13) toward the fixing device 80. In the fixing device 80, heat and pressure are applied to the toner images by the heating roller 82 and the pressure roller 84, whereby the toner images are fixed on the sheet member P. Furthermore, the sheet member P having the fixed toner images is output to, for example, the sheet output portion 15. When images are to be formed on both sides of the sheet member P, the sheet member P having the toner images fixed on the front side thereof by the fixing device 80 is fed into the reversing portion 33 in the direction of arrow −V and is then fed out of the reversing portion 33 in the direction of arrow +V, whereby the leading end and the trailing end of the sheet member P are reversed. Subsequently, the sheet member P is transported along the duplex transport path 29 in the direction of arrow B (to the left in FIG. 13) and is fed into the transport path 28. Then, image formation and fixing are performed on the back side of the sheet member P in the same manner as for the front side.

Feature Configuration

The charging device 64 will now be described.

Figure 3:
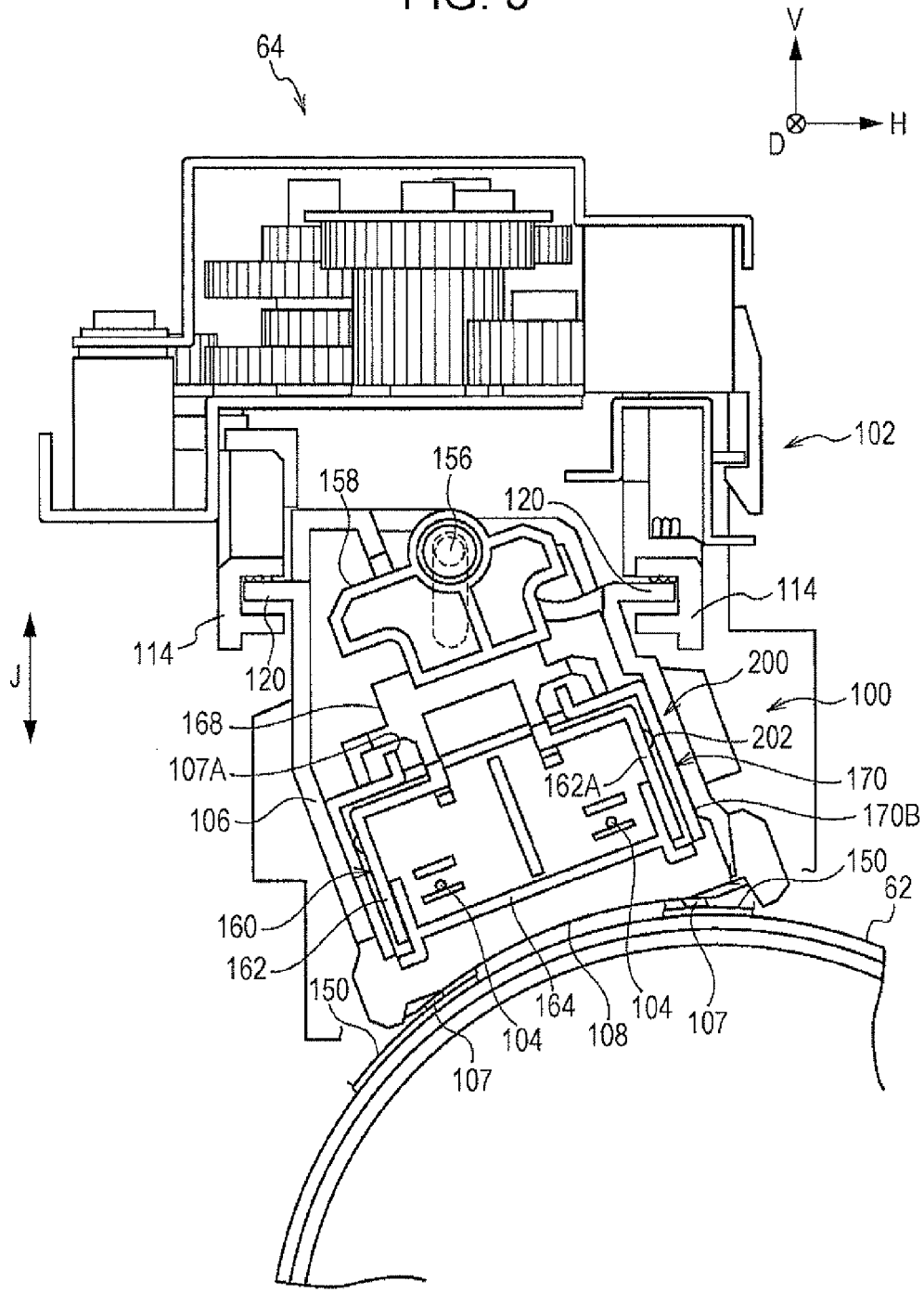
FIG. 3 is another sectional view of the charging device according to the first exemplary embodiment of the present invention.
Figure 11:
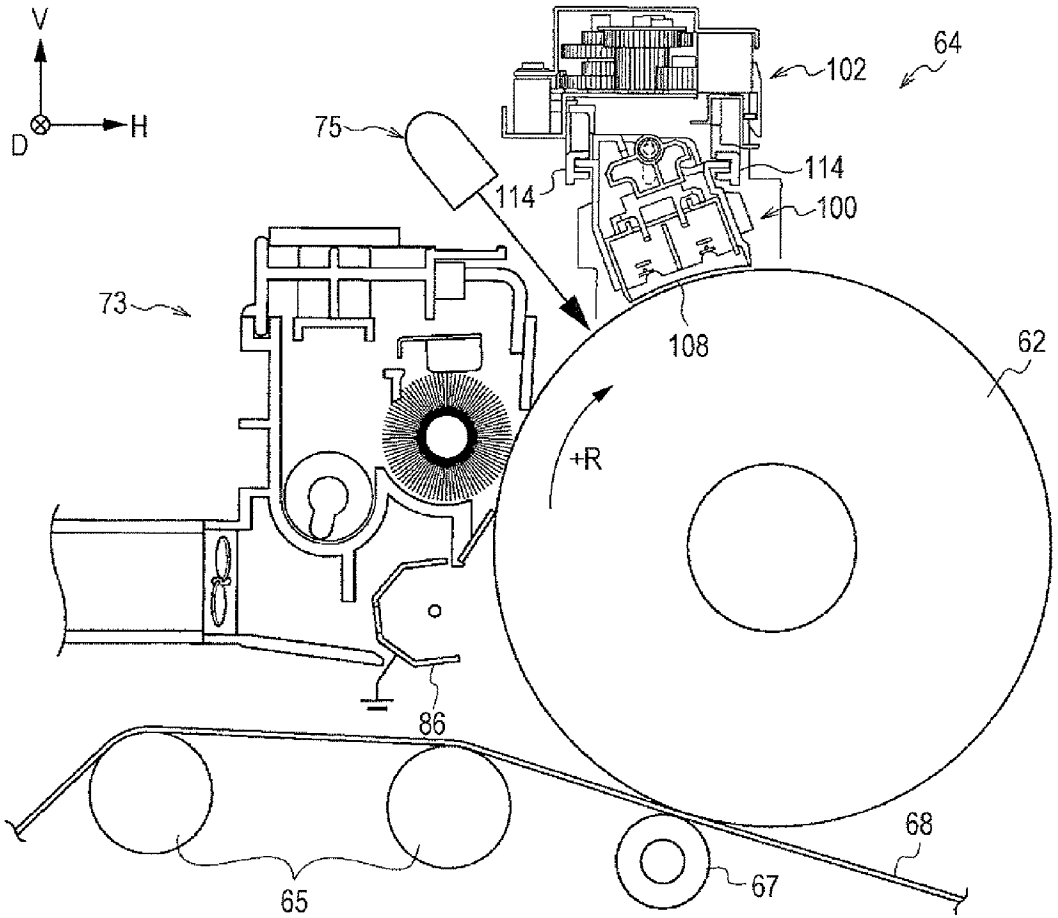
FIG. 11 illustrates the charging device and other elements included in an image forming apparatus according to the first exemplary embodiment of the present invention.

Referring to FIGS. 3 and 11, the charging device 64 includes a charger 100 and a device body 102 that supports the charger 100. The charger 100 faces the image carrier 62 and extends in the direction in which the rotational axis of the image carrier 62 extends (hereinafter simply referred to as the direction of the rotational axis, which corresponds to the depth direction in the first exemplary embodiment).

A pair of rail members 114 are provided on the device body 102. The rail members 114 hold the charger 100 therebetween from two respective sides in the horizontal direction. The rail members 114 thus supporting the charger 100 are movable close to and away from the surface of the image carrier 62 (in the direction of arrow J illustrated in FIG. 3).

The pair of rail members 114 extends in the direction of the rotational axis and have rectangular-U sectional shapes whose open sides face each other. The charger 100 has a pair of plate-shaped guide portions 120 that are inserted into the respective rail members 114 having the rectangular-U sectional shapes in the direction of the rotational axis.

The guide portions 120 are provided with movement mechanisms (not illustrated) that move the respective rail members 114 in such a direction that the charger 100 moves close to and away from the image carrier 62. Since the movement mechanisms allow the rail members 114 to move close to and away from the image carrier 62, the charger 100 is movable between a charging position (see FIG. 3) where the charger 100 is close to the surface of the image carrier 62 and charges the surface of the image carrier 62 and a retracted position (see FIG. 2) where the charger 100 is retracted away from the surface of the image carrier 62. In the state where the charger 100 is at the retracted position, the charger 100 is attached to or detached from the device body 102 with the guide portions 120 inserted into or drawn out of the rail members 114 in the direction of the rotational axis.

Charger

Figure 9:
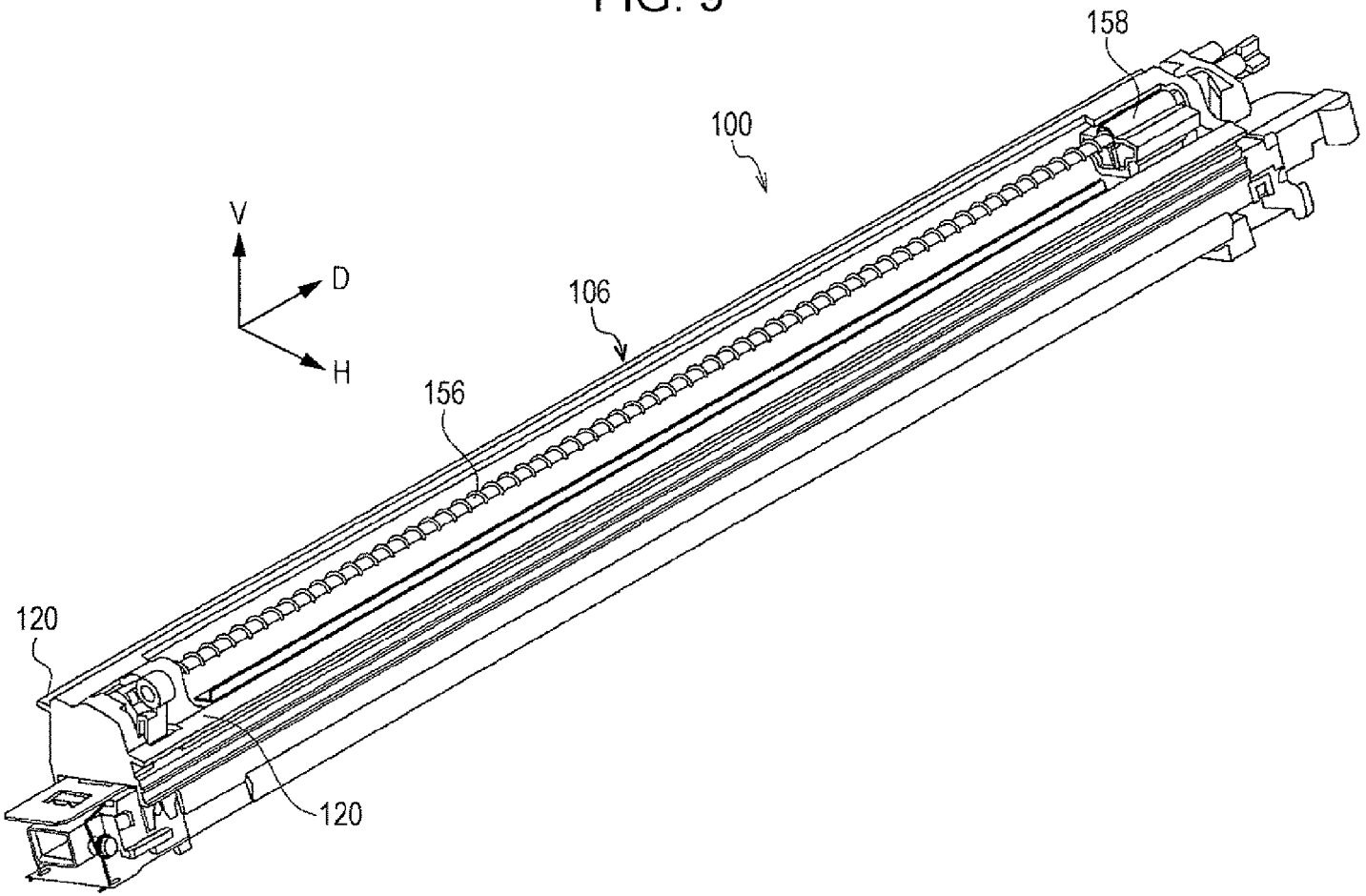
FIG. 9 is another perspective view of the charger included in the charging device according to the first exemplary embodiment of the present invention.
Figure 10:
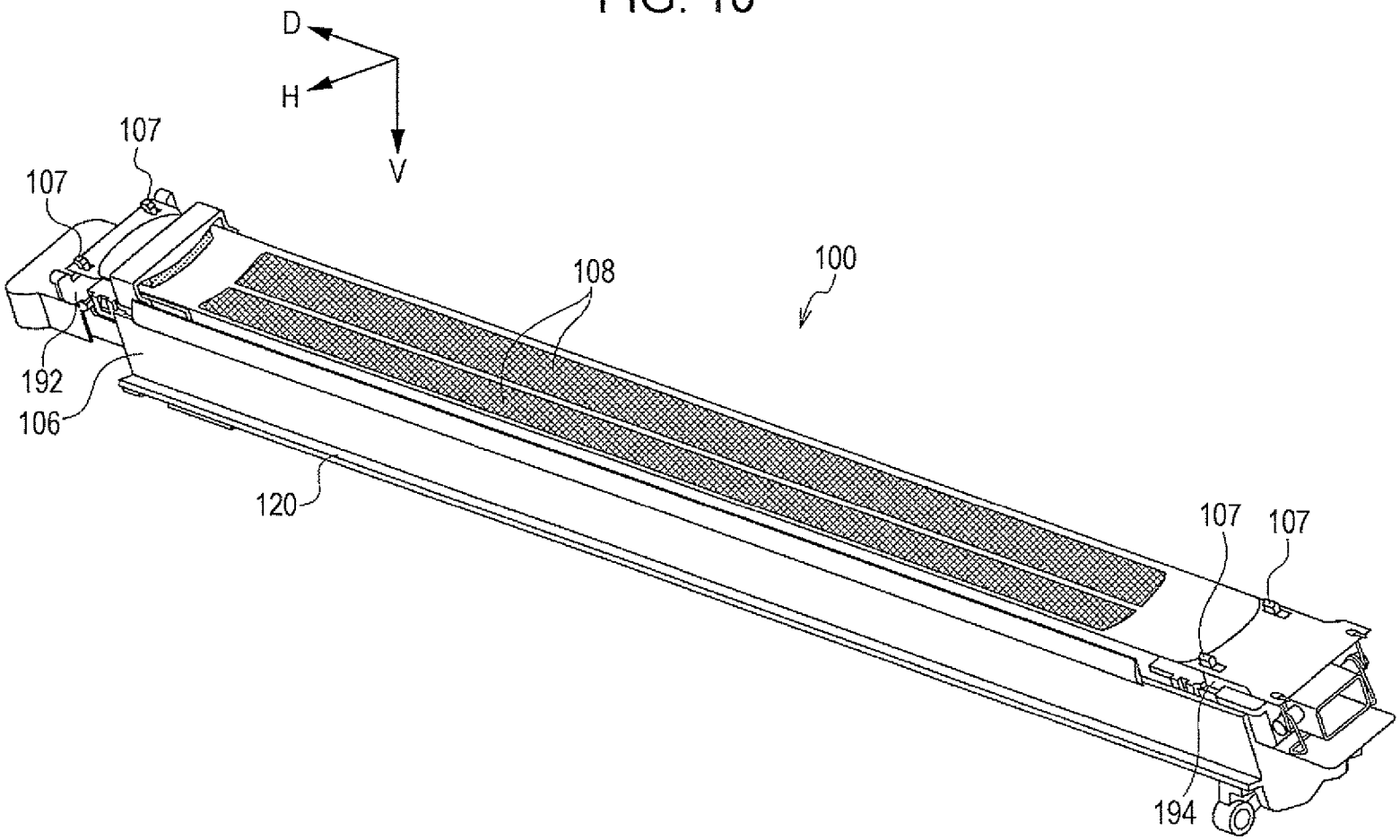
FIG. 10 is yet another perspective view of the charger included in the charging device according to the first exemplary embodiment of the present invention.

Referring to FIGS. 3, 9, and 10, the charger 100 includes a body 106 extending in the direction of the rotational axis and one of whose sides that faces the image carrier 62 (see FIG. 3) is open. The plate-shaped guide portions 120 project in the horizontal direction from the outer surface of the body 106 and extend in the direction of the rotational axis.

Figure 8:
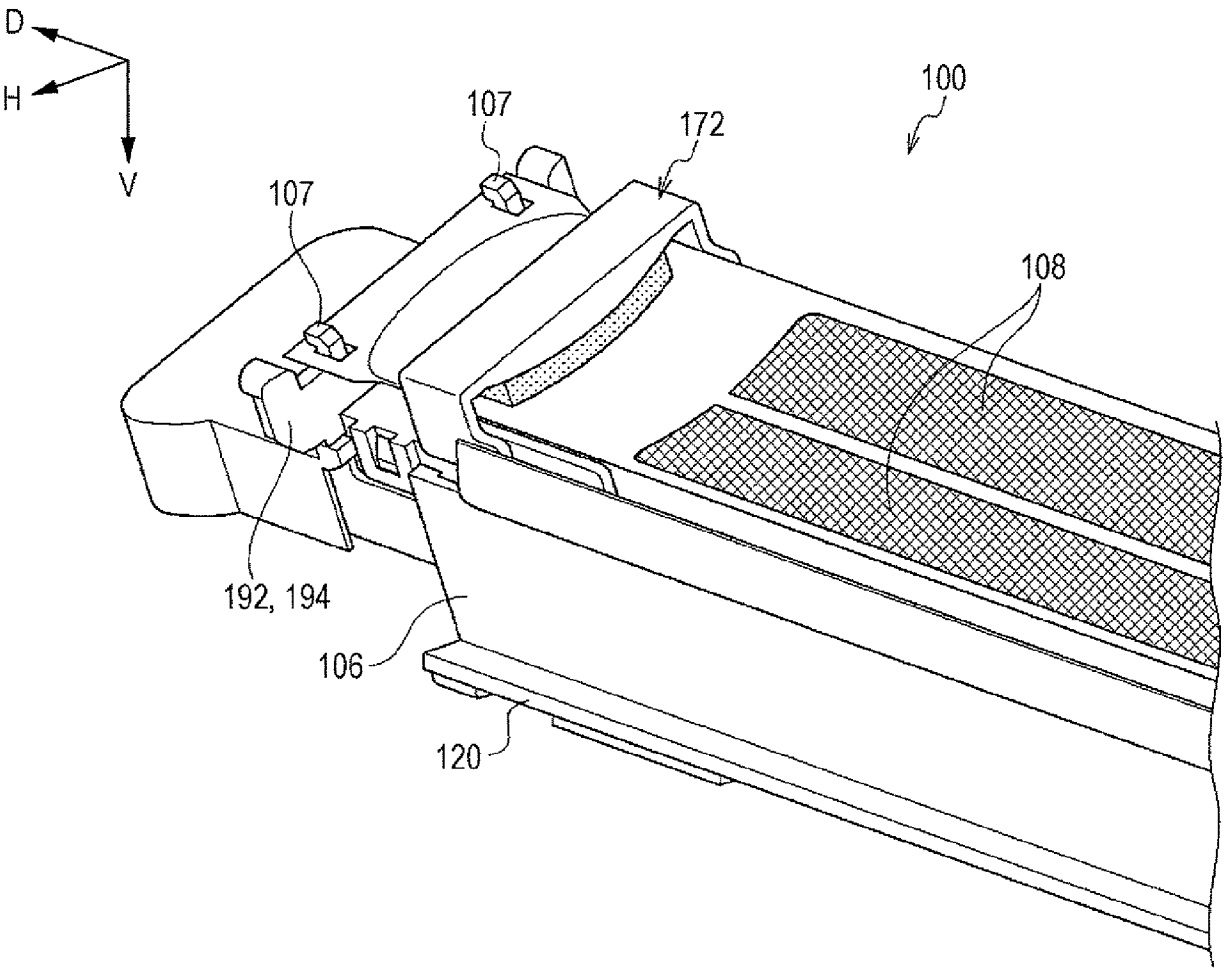
FIG. 8 is a perspective view of a charger included in the charging device according to the first exemplary embodiment of the present invention.

Referring to FIGS. 8 and 10, wire supporting members 192 and 194 that support ends of discharge wires 104, to be described separately below, are provided on two outer sides, respectively, in the direction of the rotational axis with respect to the body 106. The wire supporting members 192 and 194 each have a pair of projections 107 provided at a distance from each other in the horizontal direction and projecting toward the image carrier 62 (see FIG. 3).

In the state where the charger 100 is at the charging position as illustrated in FIG. 3, the projections 107 are in contact with position reference portions 150 provided at two ends of the image carrier 62, whereby the position of the charger 100 relative to the image carrier 62 is determined.

The charger 100 includes a shield case 170 as an exemplary case, two discharge wires 104 as exemplary discharge electrodes, and grid electrodes 108 made of meshed metal plate. The shield case 170, which is made of metal plate, is provided inside the body 106 and extends in the direction of the rotational axis. One side of the shield case 170 that faces the image carrier 62 is open. The discharge wires 104 are provided inside the shield case 170 and extend in the direction of the rotational axis. The grid electrodes 108 are provided between the image carrier 62 and the discharge wires 104 and are curved along the outer surface of the image carrier 62. The grid electrodes 108 each have at the four corners thereof openings through which the projections 107 are made to extend, respectively, whereby the grid electrodes 108 are supported by the wire supporting members 192 and 194 (see FIG. 8).

Cleaning Device

Figure 4:
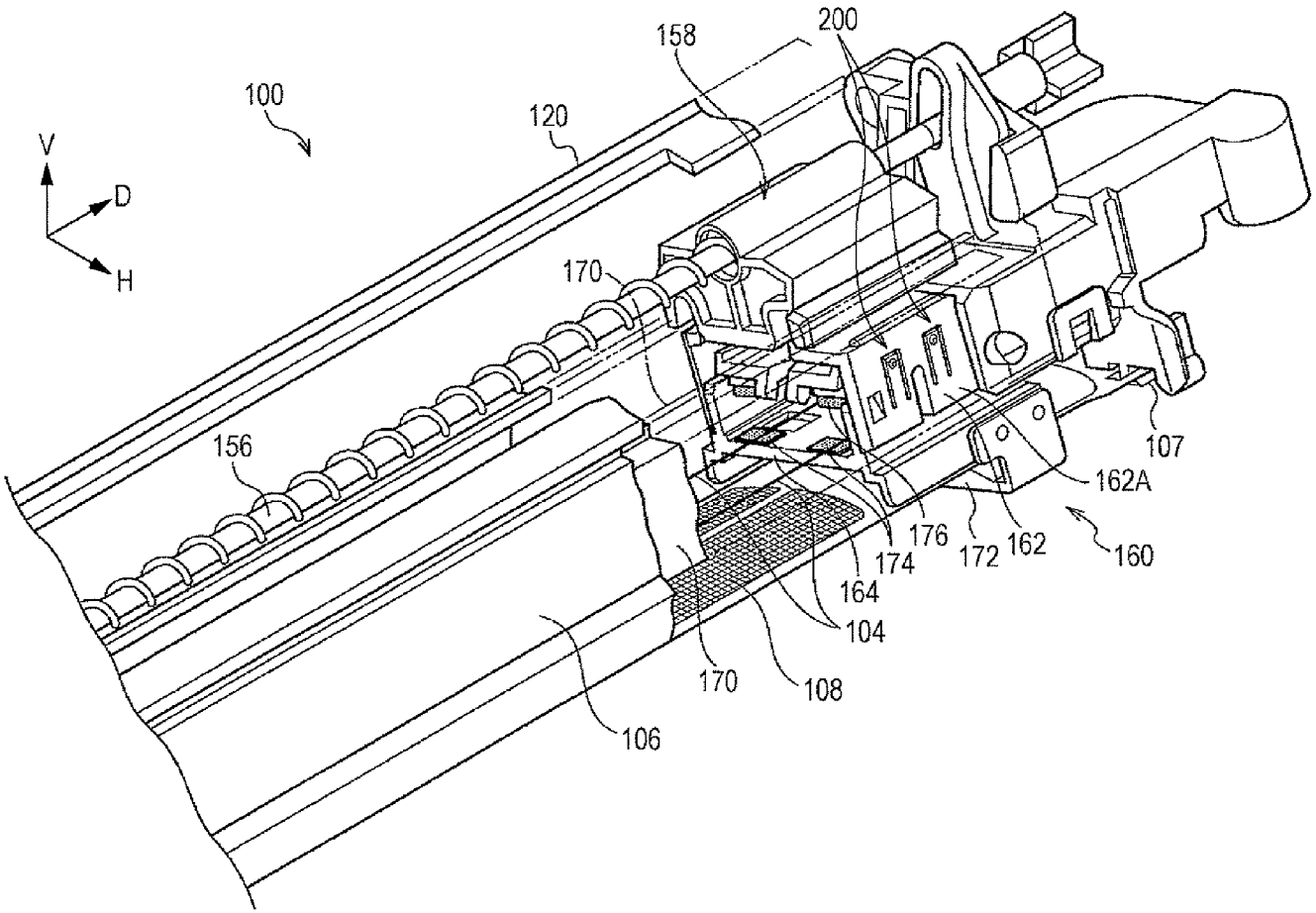
FIG. 4 is a perspective view of the charging device according to the first exemplary embodiment of the present invention.

Referring to FIG. 4, the body 106 houses a columnar lead shaft 156 and a reciprocatable member 158. The lead shaft 156 extends in the direction of the rotational axis. When the lead shaft 156 receives a driving force transmitted thereto from a drive source (not illustrated) external to the charger 100, the lead shaft 156 rotates in the circumferential direction thereof. The rotational force of the lead shaft 156 is transmitted to the reciprocatable member 158 and causes the reciprocatable member 158 to move back and forth in the direction of the rotational axis.

Figure 6:
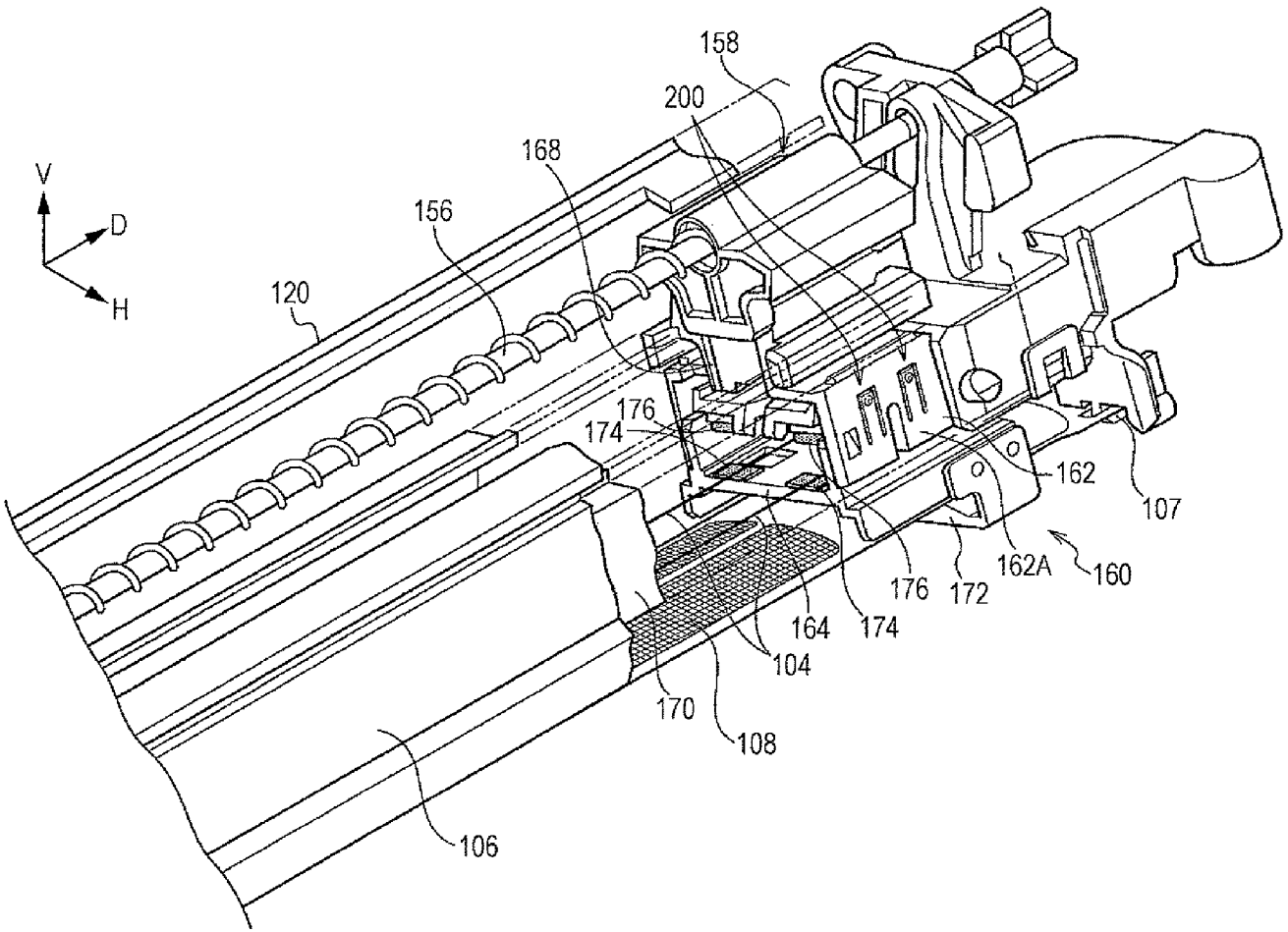
FIG. 6 is yet another perspective view of the charging device according to the first exemplary embodiment of the present invention.

In FIG. 4, the charger 100 is at the retracted position. In FIG. 6, the charger 100 is at the charging position. As illustrated in FIGS. 4 and 6, a cleaning member 160 is provided inside the shield case 170. The cleaning member 160 is connected to the reciprocatable member 158 through an opening 170A provided at the top of the shield case 170 and is supported in such a manner as to be movable in the height direction of the cleaning member 160 (in the direction of arrow M illustrated in FIG. 2) relative to the reciprocatable member 158. The moving force of the reciprocatable member 158 acting in the direction of the rotational axis is transmitted to the cleaning member 160.

The cleaning member 160 includes a connecting portion 168 and a body 162 provided integrally with the connecting portion 168. The connecting portion 168 is supported in such a manner as to be movable close to and away from the reciprocatable member 158. The moving force of the reciprocatable member 158 acting in the direction of the rotational axis is transmitted to the connecting portion 168. The body 162 has a rectangular-U sectional shape with one side thereof nearest to the image carrier 62 being open.

The cleaning member 160 further includes a bottom portion 164 secured to one side of the body 162 nearest to the image carrier 62. The body 162 and the bottom portion 164 in combination define a closed cross section. A grid cleaning portion 172 is secured to two ends of the bottom portion 164 in the horizontal direction and is provided across the grid electrodes 108 from the bottom portion 164. The grid cleaning portion 172 cleans the grid electrodes 108 by coming into contact with the outer surfaces (surfaces facing the image carrier 62) of the grid electrodes 108.

As illustrated in FIGS. 4 and 6, the bottom portion 164 is provided with cleaning pads 174 that are in contact with the discharge wires 104 from below and clean the discharge wires 104. Furthermore, cleaning pads 176 are provided inside the body 162. When the cleaning member 160 moves from one end in the direction of the rotational axis and reaches a cleaning start position where the cleaning of the discharge wires 104 is started, the cleaning pads 176 come into contact with the discharge wires 104 from above and clean the discharge wires 104.

Figure 5:
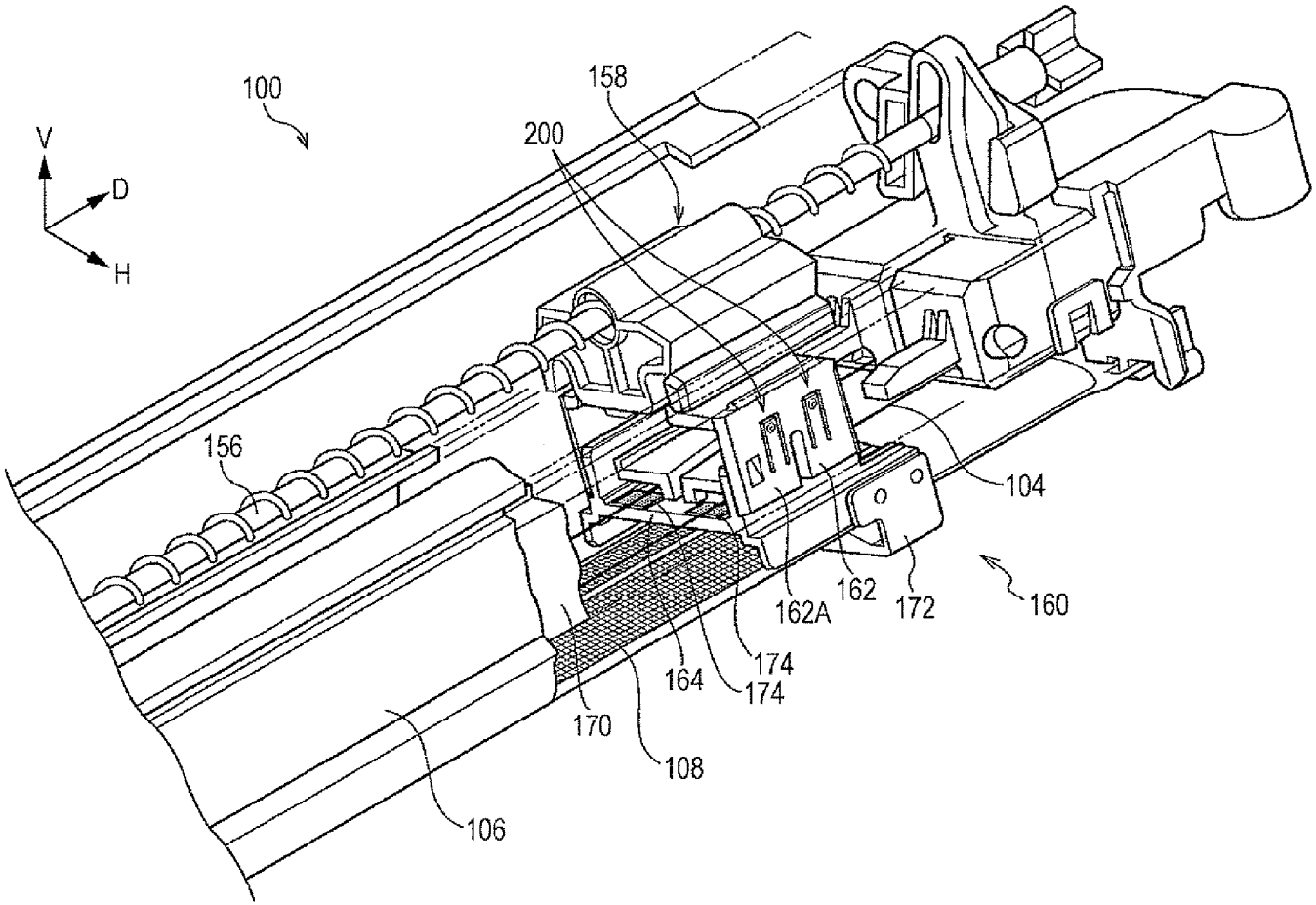
FIG. 5 is another perspective view of the charging device according to the first exemplary embodiment of the present invention.
Figure 7A:
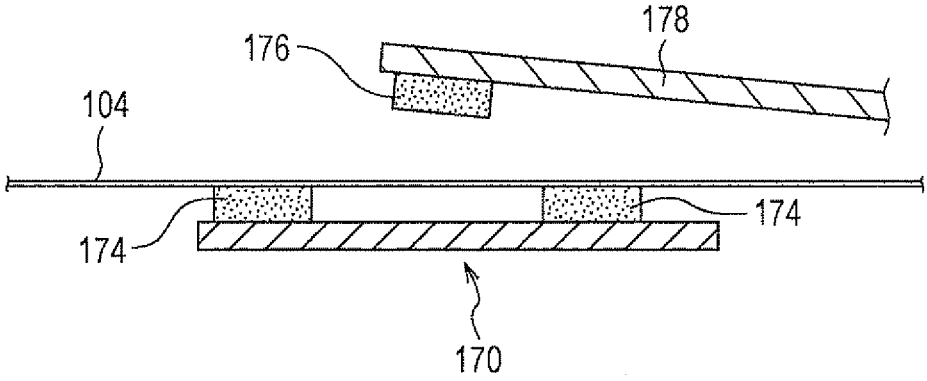
FIG. 7A illustrates a state where the cleaning member included in the charging device according to the first exemplary embodiment of the present invention is away from discharge wires.
Figure 7B:
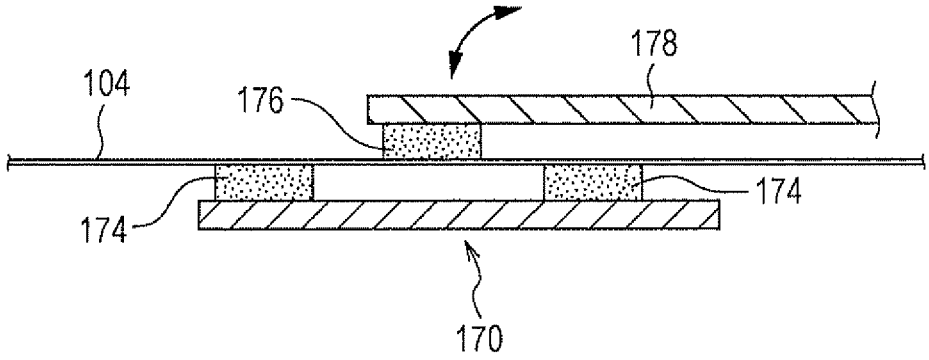
FIG. 7B illustrates a state where the cleaning member included in the charging device according to the first exemplary embodiment of the present invention is in contact with the discharge wires.

Specifically, referring to FIGS. 7A and 7B, the cleaning pads 176 are each attached to one end of a support member 178 extending in the direction of the rotational axis. The support member 178 rotates about the other end thereof. In a state illustrated in FIGS. 4 and 7A where the cleaning member 160 is standing by at the end of the charger 100, the cleaning pads 176 are held away from the discharge wires 104. When the cleaning member 160 standing by at the end of the charger 100 that is at the retracted position is moved in the direction of the rotational axis to the cleaning start position by rotating the lead shaft 156, the support members 178 rotate as illustrated in FIGS. 5 and 7B and the cleaning pads 176 come into contact with the discharge wires 104 from above.

Hence, in the state where the charger 100 is at the retracted position, the cleaning member 160 having received the moving force of the reciprocatable member 158 acting in the direction of the rotational axis is guided by and moves back and forth along the shield case 170, which has a long shape, in the direction of the rotational axis. Thus, the cleaning member 160 cleans the discharge wires 104 and the grid electrodes 108. Specifically, when the charger 100 is brought to the retracted position, a gap that allows the grid cleaning portion 172 to pass therethrough is provided between the image carrier 62 and the grid electrodes 108. The grid cleaning portion 172 moves back and forth in this gap. Thus, the grid electrodes 108 are cleaned.

Guide Mechanisms

Guide mechanisms 200 that help the shield case 170 having a long shape guide the cleaning member 160 will now be described.

Figure 1:
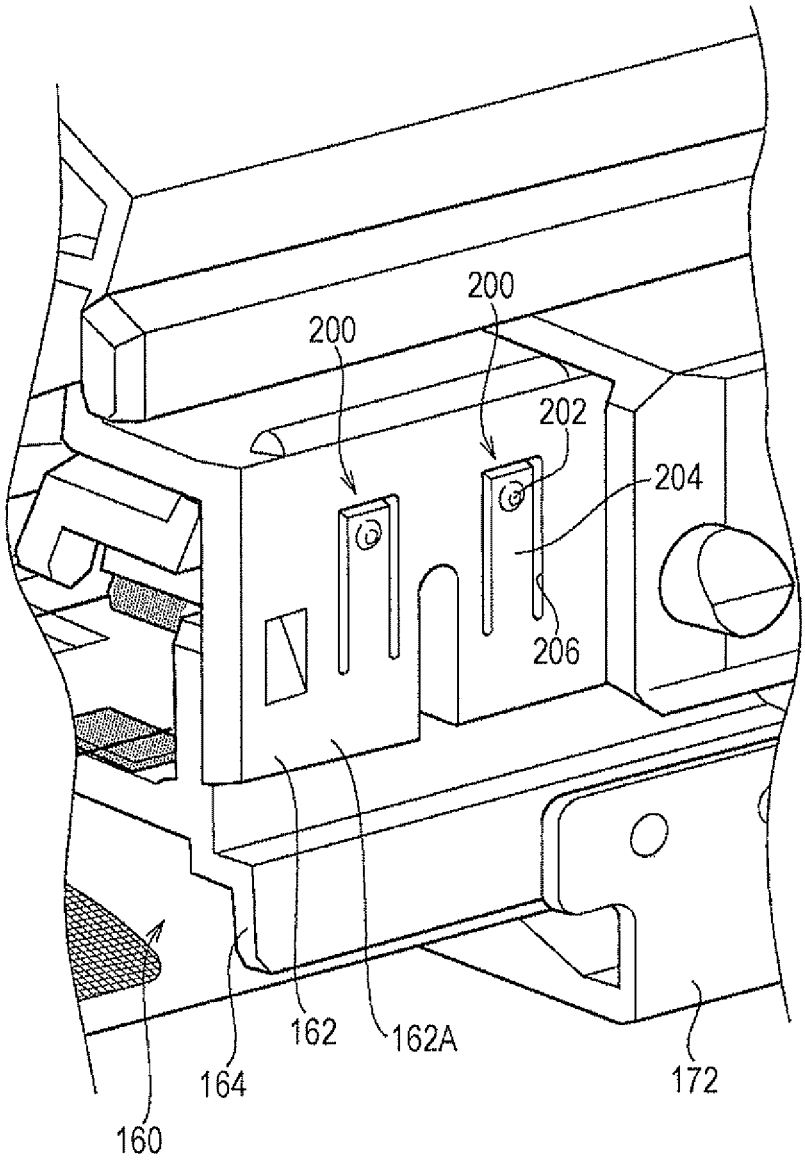
FIG. 1 is an enlarged perspective view of a cleaning member included in a charging device according to a first exemplary embodiment of the present invention.
Figure 2:
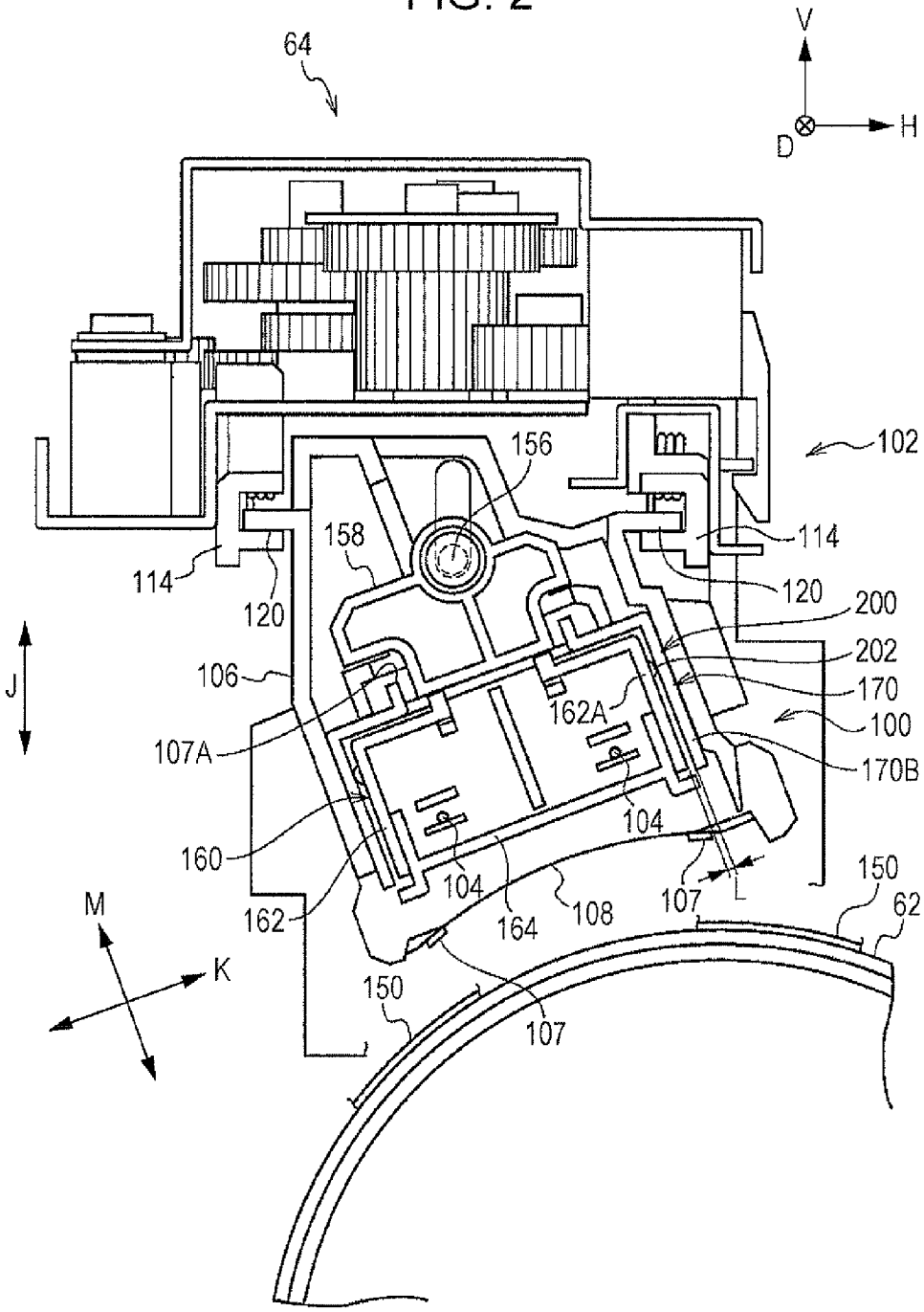
FIG. 2 is a sectional view of the charging device according to the first exemplary embodiment of the present invention.

Referring to FIGS. 1 and 2, the guide mechanisms 200 are provided as part of a pair of vertical walls 162A included in the body 162 of the cleaning member 160 and facing each other. Each of the vertical walls 162A has two guide mechanisms 200 provided side by side in the direction of the rotational axis.

Specifically, the guide mechanisms 200 each include a hemispherical projection 202, as an exemplary regulating portion, provided between the cleaning member 160 and the shield case 170. The projection 202 faces a corresponding one of vertical walls 170B of the shield case 170 with a gap of, for example, 0.1 mm to 0.2 mm interposed therebetween. When the cleaning member 160 moves along the shield case 170, the projections 202 come into contact with the vertical walls 170B of the shield case 170. That is, since the projections 202 come into contact with the vertical walls 170B, the distance between the cleaning member 160 and the shield case 170 (a distance L illustrated in FIG. 2) in a direction orthogonal to the direction of movement of the cleaning member 160 (the direction of arrow K illustrated in FIG. 2 corresponding to the width direction of the cleaning member 160 in the first exemplary embodiment) is regulated.

Furthermore, the guide mechanisms 200 each include a supporting portion 204 that supports and allows a corresponding one of the projections 202 to be movable in a direction away from a corresponding one of the vertical walls 170B of the shield case 170 that is to come into contact with the projection 202.

Specifically, the supporting portion 204 is provided as a leaf spring, with an inverted-U-shaped slit 206 provided in the vertical wall 162A. The supporting portion 204 extends in the height direction of the cleaning member 160 (the direction of arrow M illustrated in FIG. 2) with the projection 202 integrally provided at the tip thereof. When the supporting portion 204 elastically bends inward about the base end thereof, the projection 202 moves away from the vertical wall 170B of the shield case 170. The projection 202 returns to its initial position with a restoring force exerted by the supporting portion 204 that has bent.

Functions of Feature Configuration

Functions of the feature configuration will now be described.

In FIG. 4, the charger 100 is at the retracted position. When the lead shaft 156 is rotated in the forward direction as illustrated in FIGS. 5 and 7B, the reciprocatable member 158 and the cleaning member 160 connected to the reciprocatable member 158 move toward one side in the direction of the rotational axis to the cleaning start position.

When the cleaning member 160 reaches the cleaning start position, the support members 178 rotate, whereby the cleaning pads 176 come into contact with the discharge wires 104 from above (see FIGS. 7A and 7B).

In this state, when the lead shaft 156 is rotated in the forward and backward directions, the cleaning member 160 guided along the shield case 170 via the guide mechanisms 200 moves to the one side and to the other side (moves back and forth) in the direction of the rotational axis and thus cleans the discharge wires 104 and the grid electrodes 108.

Referring to FIGS. 2 and 5, when the cleaning member 160 moves along the shield case 170, the projections 202 of the guide mechanisms 200 provided as part of the vertical walls 162A come into contact with the vertical walls 170B of the shield case 170. Thus, the distance between the cleaning member 160 and the shield case 170 (the distance L illustrated in FIG. 2) in the width direction of the cleaning member 160 (in the direction of arrow K illustrated in FIG. 2) is regulated.

That is, the cleaning member 160 moves back and forth in the direction of the rotational axis along the shield case 170 while a specific gap is retained between the cleaning member 160 and the shield case 170 in the width direction of the cleaning member 160.

The projections 202 move in the direction away from the vertical walls 170B of the shield case 170 when the supporting portions 204 that support the respective projections 202 elastically bend inward about the base ends thereof. Furthermore, the restoring force exerted by the bent supporting portions 204 causes the projections 202 to be pressed toward the vertical walls 170B of the shield case 170.

For example, if any discharge products generated by the discharge from the discharge wires 104 adhere to the vertical walls 170B of the shield case 170 or if the vertical walls 170B of the shield case 170 is deformed, the sliding resistance produced between the vertical walls 170B and the projections 202 sliding therealong may increase. In such a case, however, since the supporting portions 204 support the projections 202 such that the projections 202 are movable in the direction away from the vertical walls 170B of the shield case 170, the supporting portions 204 bend and thus suppress the increase in the sliding resistance (the sliding resistance value falls within a specific range).

Since the increase in the sliding resistance produced between the projections 202 and the vertical walls 170B of the shield case 170 is suppressed, the probability that the movement of the cleaning member 160 that cleans the discharge wires 104 and the grid electrodes 108 by moving may be hindered is reduced.

Since the probability that the movement of the cleaning member 160 may be hindered is reduced, the occurrence of failure in cleaning the discharge wires 104 and the grid electrodes 108 is suppressed.

Since the occurrence of failure in cleaning the discharge wires 104 and the grid electrodes 108 is suppressed, the occurrence of failure in charging the image carrier 62 is suppressed.

Since the occurrence of failure in charging the image carrier 62 is suppressed, the occurrence of nonuniformity in the density of the output image in the direction of the rotational axis is suppressed.

The rattling of the cleaning member 160 that may occur with respect to the shield case 170 is suppressed. Therefore, the twisting of the discharge wires 104 is suppressed.

The projections 202 and the supporting portions 204 are provided as part of the body 162 of the cleaning member 160. Therefore, the number of components is reduced.

Since the projections 202 and the supporting portions 204 are provided as part of the body 162 of the cleaning member 160, a low-cost configuration is realized.

A charging device and an image forming apparatus according to a second exemplary embodiment of the present invention will now be described with reference to FIGS. 14 and 15. Elements the same as those of the first exemplary embodiment are denoted by the same reference numerals as those used in the first exemplary embodiment, and description thereof is omitted.

Figure 14:
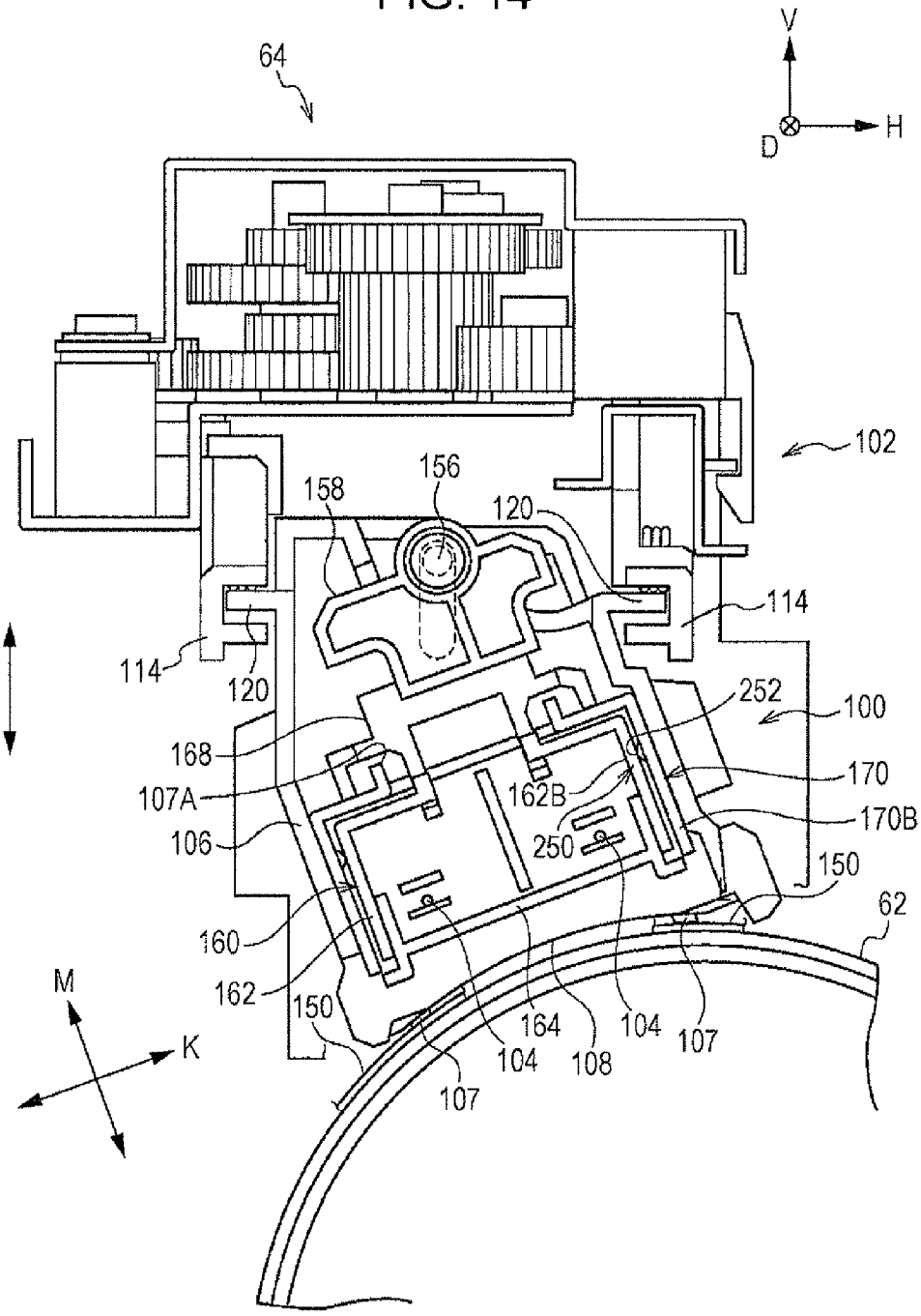
FIG. 14 is a sectional view of a charging device according to a second exemplary embodiment of the present invention.
Figure 15:
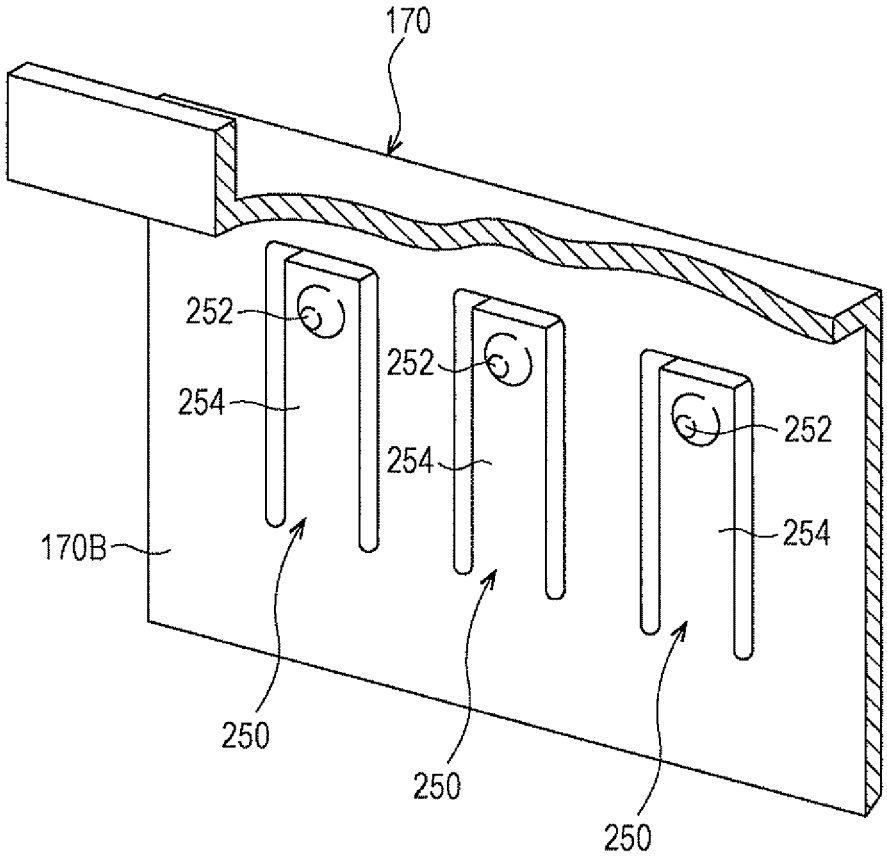
FIG. 15 is an enlarged perspective view of a case included in the charging device according to the second exemplary embodiment of the present invention.

Referring to FIGS. 14 and 15, guide mechanisms 250 that help the shield case 170 having a long shape guide the cleaning member 160 are not included in the cleaning member 160 but are included in the shield case 170.

Specifically, supporting portions 254 included in the respective guide mechanisms 250 are each provided as a leaf spring, with an inverted-U-shaped slit 256 provided in a corresponding one of the vertical walls 170B of the shield case 170. The supporting portions 254 extend in the height direction of the cleaning member 160 (the direction of arrow M illustrated in FIG. 14). The supporting portions 254 are provided integrally with projections 252, respectively, at the tips thereof. The projections 252 come into contact with the vertical walls 162A of the body 162. Therefore, when the supporting portions 254 elastically bend outward about the base ends thereof, the projections 252 move away from the vertical walls 162A. The restoring force exerted by the bent supporting portions 254 causes the projections 252 to be pressed toward the vertical walls 162A.

The pitch of the guide mechanisms 250 (the pitch of the projections 252) is set to such a value that plural (two, for example) projections 252 are in contact with each of the vertical walls 162A of the body 162 included in the cleaning member 160 while the cleaning member 160 is moving.

Thus, the orientation of the cleaning member 160 that is moving is stabilized. Other functions are the same as those described in the first exemplary embodiment.

Although the above exemplary embodiments concern a case where the cleaning member 160 cleans the discharge wires 104 and the grid electrodes 108, the cleaning member may clean the case. At least one of the discharge wires, the case, and the grid electrodes only needs to be cleaned.

Although the above exemplary embodiments concern a case where the projections 202 or 252 regulate the distance between the cleaning member 160 and the shield case 170 in the width direction of the cleaning member 160 (the direction of arrow K illustrated in FIG. 2 or 14), the distance only needs to be in a direction orthogonal to the direction of movement of the cleaning member 160. For example, the projections may regulate a distance between the cleaning member 160 and the shield case 170 in the height direction of the cleaning member 160 (in the direction of arrow M illustrated in FIG. 2 or 14).

Although the first exemplary embodiment concerns a case where two guide mechanisms 200 are provided on each side, the guide mechanisms may be provided in any number (for example, one or three or more).

Although the first exemplary embodiment concerns a case where a gap (for example, 0.1 mm to 0.2 mm) is provided between the projections 202 and the vertical walls 170B of the shield case 170, the projections and the vertical walls may be initially in contact with each other. Moreover, the supporting portions may be initially bent such that the projections are pressed toward the vertical walls. In such a case, the restoring force exerted by the bent supporting portions causes the projections to be pressed toward the vertical walls of the shield case. Therefore, the rattling of the cleaning member that may occur with respect to the shield case is suppressed.

Although the above exemplary embodiments concern a case where the grid electrodes 108 are curved, the grid electrodes are not limited to be curved and may be flat or the like.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging device comprising:

a discharge electrode that faces a surface of a rotatable image carrier and charges the surface of the image carrier, the discharge electrode having a substantially long shape extending in a direction in which a rotational axis of the image carrier extends;

a case that extends in a longitudinal direction of the discharge electrode and encloses the discharge electrode, a side of the case nearest to the image carrier being open;

a substantially plate-shaped grid electrode that is provided between the image carrier and the discharge electrode;

a cleaning member that cleans at least one of the discharge electrode and the grid electrode by being guided along the case and moving in a longitudinal direction of the case;

a regulating portion that is provided between the cleaning member and the case and regulates a distance between the cleaning member and the case in a direction orthogonal to the direction of movement of the cleaning member by coming into contact with one of the cleaning member and the case; and a supporting portion that supports the regulating portion and allows the regulating portion to move in a direction away from one of the cleaning member and the case with which the regulating portion is to come into contact, wherein the supporting portion extends in a height direction of the cleaning member and comprises a leaf spring formed by a slit in a vertical wall of the case or the cleaning member, wherein the regulating portion comprises projections and at least one of these projections is integrally disposed at a tip of the leaf spring, and wherein when the cleaning member moves along the case, only the projections contact an inner wall of the case or an outer wall of the cleaning member.

2. The charging device according to claim 1, wherein the supporting portion presses the regulating portion toward one of the cleaning member and the case that is to come into contact with the regulating portion.

3. The charging device according to claim 2, wherein the regulating portion and the supporting portion are included in the cleaning member.

4. The charging device according to claim 2, wherein the regulating portion and the supporting portion are included in the case.

5. The charging device according to claim 1, wherein the regulating portion and the supporting portion are included in the cleaning member.

6. The charging device according to claim 1, wherein the regulating portion and the supporting portion are included in the case.

7. An image forming apparatus comprising:

an image carrier;

the charging device according to claim 1 that charges the surface of the image carrier; and a developing device that develops an electrostatic latent image formed on the surface of the image carrier charged by the charging device into a toner image.

* * * * *